US009341093B2

(12) United States Patent
Miyajima et al.

(10) Patent No.: US 9,341,093 B2
(45) **Date of Patent: *May 17, 2016**

(54) CONTROL VALVE

(71) Applicant: YAMADA MANUFACTURING CO., LTD, Kiryu-shi (JP)

(72) Inventors: Junichi Miyajima, Isesaki (JP); Hidehiko Koyashiki, Isesaki (JP); Takatoshi Watanabe, Isesaki (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 341 days.

This patent is subject to a terminal disclaimer.

(21) Appl. No.: 13/934,111

(22) Filed: Jul. 2, 2013

(65) Prior Publication Data

US 2014/0007836 A1 Jan. 9, 2014

(30) Foreign Application Priority Data

Jul. 6, 2012 (JP) ..... 2012-152481

(51) Int. Cl.
*F01M 1/02* (2006.01)
*F01M 3/00* (2006.01)
*F01M 1/16* (2006.01)

(52) U.S. Cl.
CPC . *F01M 3/00* (2013.01); *F01M 1/02* (2013.01); *F01M 1/16* (2013.01)

(58) Field of Classification Search
CPC ..... F01L 1/3442; F01L 2001/34426; F01L 9/025; F01L 1/26; F01M 1/16; B60W 2510/1075; F04C 14/26
USPC ..... 123/196 R; 137/625.14, 625.66–625.69, 137/115.13, 109, 118.06, 599.09, 487, 489
See application file for complete search history.

(56) References Cited

U.S. PATENT DOCUMENTS 4,080,946 A * 3/1978 Cunningham ..... F01M 1/22 123/196 S
4,556,078 A * 12/1985 Wittren ..... B65D 5/07 137/101

(Continued)

FOREIGN PATENT DOCUMENTS

JP 2009-264241 A 11/2009

OTHER PUBLICATIONS

United States Office Action dated Jun. 8, 2015 in co-pending U.S. Appl. No. 13/934,098.

*Primary Examiner* — Marguerite McMahon
*Assistant Examiner* — James Kim
(74) *Attorney, Agent, or Firm* — McGinn IP Law Group, PLLC

(57) ABSTRACT

A control valve have a main channel, a channel cross section adjustment spool, a downstream side branching channel, a communication channel, a channel open and close spool, a channel open and close valve, and a upstream side branching channel. In a low rotation speed region of an engine, the channel open and close valve blocks the communication channel. In a medium rotation speed region, the channel open and close spool allows the communication between the downstream side branching channel and the communication channel, and the channel open and close valve allows the communication channel to communicate to slide and move the channel cross section adjustment spool in a direction. In a high rotation speed region, the channel open and close spool blocks the communication between the downstream side branching channel.

11 Claims, 6 Drawing Sheets

(56) References Cited

U.S. PATENT DOCUMENTS 5,058,626 A * 10/1991 Takaoka ..... B65D 5/087 137/625.66
5,085,181 A 2/1992 Feuling
5,253,672 A * 10/1993 Uehara ..... F15B 11/08 137/489
5,273,297 A * 12/1993 Gerdes ..... B60G 17/056 137/625.61
6,443,263 B1 9/2002 Ito et al.
8,267,121 B2 * 9/2012 Gruel ..... F16K 11/0716 137/1
9,038,659 B2 5/2015 Watanabe et al.
2005/0142006 A1 6/2005 Voigt
2010/0006063 A1 * 1/2010 Dilly ..... F01L 13/06 123/347
2011/0067667 A1 3/2011 Miyachi et al.
2011/0067668 A1 3/2011 Miyachi et al.
2011/0232594 A1 9/2011 Miyachi et al.

* cited by examiner

CONTROL VALVE

BACKGROUND OF THE INVENTION

1. Field of the Invention

The present invention relates to a control valve in a lubricant supply apparatus for an engine, in particular in a lubricant supply apparatus including a valve gear supply channel through which a lubricant is fed to a cam journal in a cylinder head, and a crank shaft supply channel through which a lubricant is fed to a crank shaft, a connecting rod, and the like in a cylinder block, the control valve adjusting a hydraulic pressure supplied to each of the channels.

2. Description of the Related Art

Attempts have been made to vary the hydraulic pressure of oil fed from an oil pump according to the rotation speed of an engine so as to supply oil with the optimum hydraulic pressure for each rotation speed region. Attempts have also been made to reduce a load on the oil pump by adjusting a hydraulic pressure supplied to each of a valve gear lubrication circuit and a crank shaft lubrication circuit to a value needed for the circuit.

To achieve such an object, an invention disclosed in Japanese Patent Application Laid-Open No. 2009-264241 has been provided. The invention in Japanese Patent Application Laid-Open No. 2009-264241 will be described below in brief. Reference numerals in the following description are the same as reference numerals described in Japanese Patent Application Laid-Open No. 2009-264241. First, oil is pumped from an oil pan 10 by an oil pump 12 and fed to a first feeding path 16*a* and a second feeding path 16*b*.

The first feeding path 16*a* is a path that supplies oil mostly to a bearing portion 18 of the crank shaft. The second feeding path 16*b* is a path that supplies oil to, for example, a valve gear mechanism 20. A hydraulic control valve 22 is disposed on the first feeding path 16*a* to control the amount of oil supplied to the bearing portion 18 of the crank shaft. The hydraulic control valve 22 is configured such that an output hydraulic pressure from the hydraulic control valve 22 is controlled by a control unit 24.

The control unit 24 is controlled by an engine rotation speed sensor 26, an engine load sensor 28, an oil temperature sensor 30, and a hydraulic pressure sensor 32. A relief valve 34 is provided to transfer an excessive hydraulic pressure to the oil pan 10 through an oil path portion between the oil pump 12 and a filter 14 when the hydraulic pressure exceeds a predetermined value. In the above-described configuration, the hydraulic control valve 22 is controlled by the control unit 24.

The invention in Japanese Patent Application Laid-Open No. 2009-264241 and conventional techniques including similar configurations have the following problems. The invention in Japanese Patent Application Laid-Open No. 2009-264241 utilizes electronic control as control means. To allow the hydraulic control valve 22 to be controlled utilizing electronic control, much information on the rotation speed of the engine, an oil temperature, an engine load, the hydraulic pressure, and the like needs to be acquired. Furthermore, complicated control such as MAP control and oil temperature compensation is needed. This may significantly increase costs. Moreover, driving the hydraulic control valve 22 leads to power consumption, and a power generator needs to be driven, possibly increasing the engine load.

Additionally, if an electric system for any of the various sensors, the hydraulic control valve 22, the control unit 24, and the like becomes defective, the control is prevented from being sufficiently performed, thus precluding expected effects from being produced. Thus, an object of the present invention (technical problem to be solved) is to provide an inexpensive and reliable control valve by using a hydraulic driving mechanism to avoid the inherent problem of electronic control.

SUMMARY OF THE INVENTION

Thus, the inventors earnestly studied in order to achieve the object. As a result, a first aspect of the present invention is a control valve including a main channel, a channel cross section adjustment spool installed in a middle of the main channel to increase and reduce a channel cross section, a downstream side branching channel that branches from the main channel on a downstream side of a position of the channel cross section adjustment spool, a communication channel through which oil is fed from the downstream side branching channel toward the channel cross section adjustment spool, a channel open and close spool installed between the downstream side branching channel and the communication channel to allow and block communication between the downstream side branching channel and the communication channel, a channel open and close valve installed in a middle of the communication channel, and an upstream side branching channel that branches from the main channel on an upstream side of the position of the channel cross section adjustment spool to supply a hydraulic pressure to the channel open and close spool, wherein, in a low rotation speed region of an engine, the channel open and close valve blocks the communication channel to maximize a channel cross section of the main channel, and in a medium rotation speed region of the engine, the channel open and close spool allows the communication between the downstream side branching channel and the communication channel, and the channel open and close valve allows the communication channel to communicate to slide and move the channel cross section adjustment spool in a direction in which the channel cross section of the main channel is reduced, and in a high rotation speed region of the engine, the channel open and close spool blocks the communication between the downstream side branching channel and the communication channel to maximize the channel cross section of the main channel. Thus, the control valve has achieved the object.

A second aspect of the present invention is a control valve including a main channel, a channel cross section adjustment spool installed in a middle of the main channel, a downstream side branching channel that branches from the main channel on a downstream side of a position of the channel cross section adjustment spool, a communication channel which is in communication with the downstream side branching channel and through which oil is fed to the channel cross section adjustment spool, a channel open and close valve installed in a middle of the communication channel to allow and block communication of the communication channel, and an upstream side branching channel that branches from the main channel on an upstream side of the position of the channel cross section adjustment spool to supply a hydraulic pressure to the channel open and close spool, wherein the channel open and close spool blocks communication between the downstream side branching channel and the communication channel as a hydraulic pressure in the upstream side branching channel increases, the channel open and close valve allows the communication channel to communicate as a hydraulic pressure in the downstream side branching channel increases, and the channel cross section adjustment spool is elastically biased in such a manner as to maximize a channel cross section of the main channel, and moves in such a manner that the channel cross section is reduced as a hydraulic pressure from the communication channel increases. Thus, the control valve has achieved the object.

A third aspect of the present invention is the control valve according to the first or second aspect, wherein a hydraulic pressure needed for the channel open and close valve to allow the communication channel to communicate is set lower than a hydraulic pressure needed for the channel open and close spool to block the communication between the downstream side branching channel and the communication channel. Thus, the control valve has achieved the object.

A fourth aspect of the present invention is the control valve according to any one of the first to third aspects, wherein a drain channel is provided between a channel cross section adjustment spool chamber in which the channel cross section adjustment spool is installed and a channel open and close valve chamber in which the channel open and close valve is installed, a discharge channel is formed in the channel open and close valve chamber, and the drain channel and the discharge channel are allowed to communicate with each other when the channel open and close valve blocks the communication channel. Thus, the control valve has achieved the object.

A fifth aspect of the present invention is the control valve according to any one of the first to fourth aspects, wherein a channel cross section adjustment spool chamber in which the channel cross section adjustment spool is installed is constituted by a main chamber portion and a sub-chamber portion which are orthogonal to the main channel, and the channel cross section adjustment spool reciprocates between the main chamber portion and the sub-chamber portion in such a manner as to traverse the main channel. Thus, the control valve has achieved the object.

In the first and second aspects, the hydraulic pressure on the downstream side of the control valve is controlled according to a change in engine rotation speed, that is, a change in the hydraulic pressure in the main channel, using only a mechanical hydraulic mechanism without the use of a solenoid valve or a sensor which needs electric driving.

This eliminates the possibility of preventing appropriate hydraulic control as a result of a defect in an electric system. Thus, operating reliability is ensured which is higher than the operating reliability of a lubricant supply apparatus according to the conventional technique, and a possible increase in costs resulting from additional components and control can be suppressed.

In operation, in the medium rotation speed region of the engine, a hydraulic pressure is applied to the channel cross section adjustment spool to move the channel cross section adjustment spool in an axial direction thereof to reduce a channel cross section of an oil circuit. The reduced cross section of the oil passage enables a reduction in the hydraulic pressure on the downstream side of the channel cross section adjustment spool.

Furthermore, in the high rotation speed region of the engine, oil flowing through the communication channel is blocked by the channel open and close spool. The drain channel and the discharge channel in the channel open and close valve chamber are allowed to communicate with each other to reduce the hydraulic pressure applied to the channel cross section adjustment spool. The elastic bias force of the channel cross section adjustment spool moves the channel cross section adjustment spool in a direction in which the channel cross section of the main channel is maximized. This allows the flow rate and pressure of oil to be increased according to the rotation speed of the engine.

Thus, the aspects of the present invention prevent the downstream side hydraulic pressure from decreasing, and in the low rotation speed region of the engine, allow the hydraulic pressure to gradually rise from the time of start of the engine. In the medium rotation speed range of the engine, the aspects of the present invention can suppress a rise in hydraulic pressure to prevent wasteful use of oil. In the high rotation speed region of the engine, a high hydraulic pressure can be supplied as necessary if such a hydraulic pressure is needed for lubrication or cooling.

According to the third aspect of the present invention, a hydraulic pressure needed for the channel open and close valve to allow the communication channel to communicate is set lower than a hydraulic pressure needed for the channel cross section adjustment spool to block the communication between the downstream side branching channel and the communication channel. Thus, the hydraulic pressure of oil flowing through the main channel rises to move the channel open and close valve earlier than the channel open and close spool. As a result, an appropriate operation is performed according to the rotation speed of the engine simply by using the elastic bias force of an elastic member.

According to the fourth aspect of the present invention, the channel open and close valve blocks the communication channel to allow the channel cross section adjustment spool to operate smoothly even if the supply of the hydraulic pressure to the channel cross section adjustment spool chamber is stopped. According to the fifth aspect of the present invention, the channel cross section adjustment spool reciprocates in the axial direction in a stabilized manner.

DESCRIPTION OF THE PREFERRED EMBODIMENTS

Figure 6:
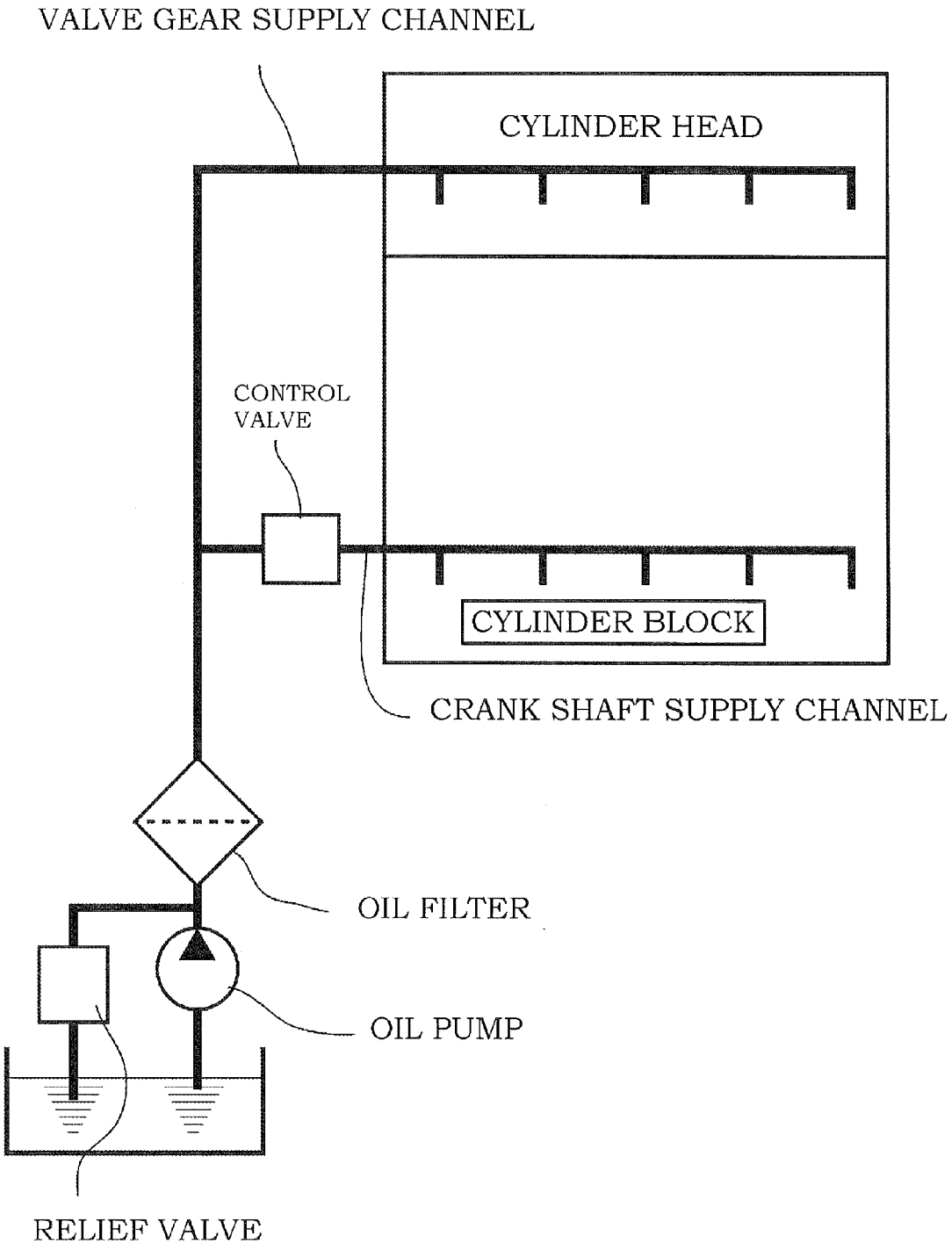
FIG. 6 is a diagram schematically showing the control valve according to the embodiment of the present invention disposed in an oil circuit.

An embodiment of the present invention will be described based on the drawings. A control valve according to the embodiment of the present invention is provided in an oil circulation circuit that supplies oil to sections of an engine. Moreover, specifically, the control valve controls oil supplied mostly to a bearing portion of a crank shaft and the like (see FIG. 6).

The control valve according to the embodiment of the present invention is disposed in the middle of a crank shaft lubrication circuit in the oil circulation circuit in the engine.

However, the control valve according to the embodiment of the present invention is also applied to the control of a valve gear lubrication circuit, and in this case, disposed in the middle of the valve gear lubrication circuit.

Figure 1A:
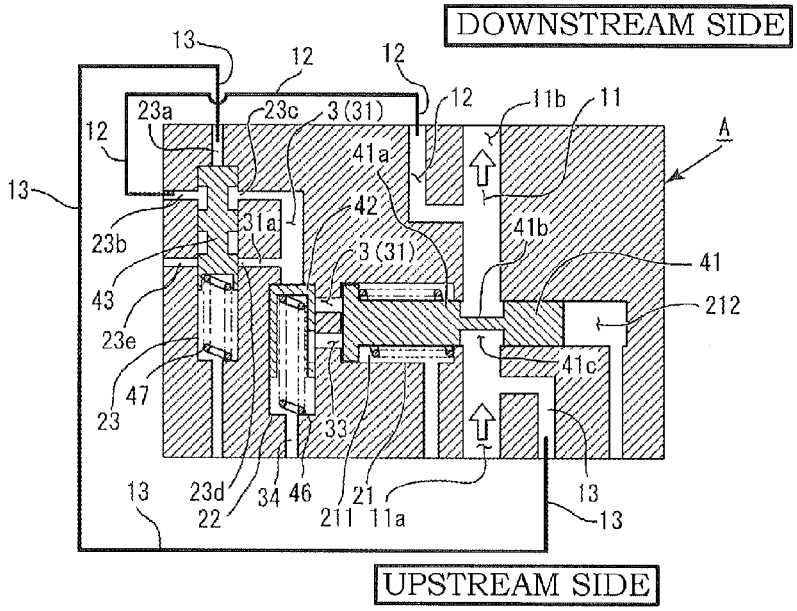
FIG. 1A is a cross-sectional view showing a configuration of a control valve according to an embodiment of the present invention.

A configuration according to the embodiment of the present invention mainly includes a housing A, a channel cross section adjustment spool 41, a channel open and close valve 42, a channel open and close spool 43, and elastic members 45, 46, and 47 that elastically bias valves in the channel cross section adjustment spool 41, the channel open and close valve 42, and the channel open and close spool 43 (see FIG. 1A). A main channel 11 is formed in the housing A. The main channel 11 forms a part of the oil circulation circuit.

Figure 1B:
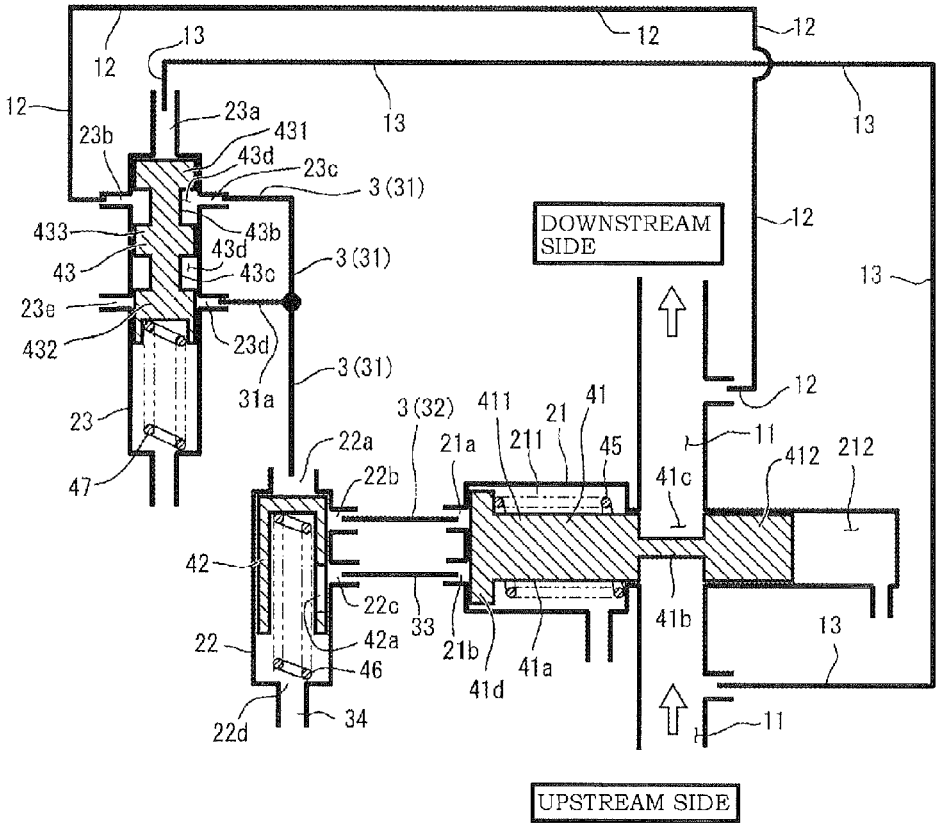
FIG. 1B is a diagram schematically showing the configuration in FIG. 1A.

Thus, when the control valve according to the embodiment of the present invention is provided in the crank shaft lubrication circuit, the main channel 11 forms a part of the crank shaft lubrication circuit. FIG. 1B is a simplified diagram showing the internal structure of the housing A in FIG. 1A.

The main channel 11 includes an inflow side connection end portion 11*a* at one end portion thereof and an outflow side connection end portion 11*b* at the other end portion thereof. Both the inflow side connection end portion 11*a* and the outflow side connection end portion 11*b* are connected to oil pipes external to the housing A. Oil in the oil circulation circuit flows in through the inflow side connection end portion 11*a* and flows out through the outflow side connection end portion 11*b*.

The housing A includes a channel cross section adjustment spool chamber 21, a channel open and close valve chamber 22, and a channel open and close spool chamber 23 formed therein. The channel cross section adjustment spool chamber 21 is formed to traverse the main channel 11. Specifically, the channel cross section adjustment spool chamber 21 is a chamber formed to orthogonally cross the main channel 11 and is separated into two chambers by the main channel 11.

One of the two chambers into which the channel cross section adjustment spool chamber 21 is separated is referred to as a main chamber portion 211. The other is referred to as a sub-chamber portion 212. The channel cross section adjustment spool 41 is installed in the channel cross section adjustment spool chamber 21. Furthermore, a downstream side branching channel 12 is formed on the downstream side of the position of the channel cross section adjustment spool chamber 21 in the main channel 11 so as to branch from the main channel 11. An upstream side branching channel 13 is formed on the upstream side of the channel cross section adjustment spool chamber 21 in the main channel 11 so as to branch from the main channel 11. For the expressions "upstream side" and "downstream side" as used herein, an inflow direction corresponds to the upstream side and an outflow direction corresponds to the downstream side as viewed from any position. Oil flows from the upstream side to the downstream side.

The channel open and close spool chamber 23 includes a top inflow port 23*a* formed at a top portion thereof, and a side inflow port 23*b* and a side outflow port 23*c* formed on the respective sides of the channel open and close spool chamber 23 and at the same position as that of the channel open and close spool chamber 23 in the axial direction thereof. Moreover, a sub-inflow port 23*d* and a sub-drain port 23*e* are formed at a position different from the position of the side inflow port 23*b* and the side outflow port 23*c* in the axial direction and away from the top inflow port 23*a*.

The channel open and close valve chamber 22 includes a top inflow port 22*a* formed at a top portion thereof and a side outflow port 22*b* formed on a side thereof. Moreover, a drain inflow port 22*c* is formed at a side position different from the position of the side outflow port 22*b* in the axial direction of the channel open and close valve chamber 22 and away from the top inflow port 22*a*. A drain discharge port 22*d* is formed at a bottom portion of the channel open and close valve chamber 22 (see FIG. 1B).

The side inflow port 23*b* of the channel open and close spool chamber 23 is in communication with the main channel 11 on the downstream side thereof via the downstream side branching channel 12. The top inflow port 23*a* is in communication with the main channel 11 on the upstream side thereof via the upstream side branching channel 13 (see FIG. 1B).

A communication channel 3 is formed between the channel open and close spool chamber 23 and the channel cross section adjustment spool chamber 21 to allow the communication between the channel open and close spool chamber 23 and the channel cross section adjustment spool chamber 21. The channel open and close valve chamber 22 is disposed at any position in the communication channel 3 (any intermediate position in the communication channel 3), and thus, the communication channel 3 is separated into two portions by the channel open and close valve chamber 22.

The communication channel 3 includes portions referred to as a first communication channel 31 and a second communication channel 32. The portion between the channel open and close spool chamber 23 and the channel open and close valve chamber 22 is referred to as the first communication channel 31. The portion between the channel open and close valve chamber 22 and the channel cross section adjustment spool chamber 21 is referred to as the second communication channel 32.

One-side end portion of the first communication channel 31 is in communication with the side outflow port 23*c* of the channel open and close spool chamber 23. The other-side end portion of the first communication channel 31 is in communication with the top inflow port 22*a* of the channel open and close valve chamber 22. Moreover, a sub-branching channel 31*a* is provided in the middle of the first communication channel 31 so as to branch from the first communication channel 31 to communicate with the sub-inflow port 23*d*.

One end portion of the second communication channel 32 is in communication with the side outflow port 22*b*, formed on a side surface portion of the channel open and close valve chamber 22 which portion is orthogonal to the axial direction of the channel open and close valve chamber 22. The other end portion of the second communication channel 32 is in communication with the top inflow port 21*a*, formed at the top portion of the channel cross section adjustment spool chamber 21. Moreover, a drain channel 33 is provided between the channel open and close valve chamber 22 and the channel cross section adjustment spool chamber 21 at a position parallel to and different from the position of the second communication channel 32 along the axial direction of the channel cross section adjustment spool chamber 21. Thus, the channel cross section adjustment spool chamber 21 and the channel open and close valve chamber 22 are in communication with each other.

Specifically, the top outflow port 21*b* is formed at the top portion of the channel cross section adjustment spool chamber 21 at a position different from the position of the top inflow port 21*a*. The drain channel 33 is formed between the drain inflow port 22*c* of the channel open and close valve chamber 22 and the top outflow port 21*b* of the channel cross section adjustment spool chamber 21 (see FIG. 1B). A discharge channel 34 is formed so as to extend from the drain discharge port 22*d* of the channel open and close valve chamber 22. The discharge channel 34 is in communication with the exterior of the housing A.

The channel cross section adjustment spool 41 is disposed in the channel cross section adjustment spool chamber 21. The channel cross section adjustment spool 41 is installed in the channel cross section adjustment spool chamber 21 so as to be movable in the axial direction thereof and to substantially orthogonally traverse the main channel 11.

Specifically, one axial portion of the channel cross section adjustment spool 41 is installed in the main chamber portion 211, whereas the other axial portion of the channel cross section adjustment spool 41 is installed in the sub-chamber portion 212. The channel cross section adjustment spool 41 moves in the axial direction thereof to change the channel cross section of the main channel 11, thus serving to control the flow rate of oil flowing through the main channel 11.

The channel cross section adjustment spool 41 includes a first sliding portion 411 interposed in the main chamber portion 211, a second sliding portion 412 interposed in the sub-chamber portion 212, a constricted portion 41*b* that connects the first sliding portion 411 and the second sliding portion 412 together, and an expanded diameter flange portion 41*d*. The first sliding portion 411 and the second sliding portion 412 have an outer diameter substantially equal to or very slightly smaller than the inner diameter of the main channel 11.

The constricted portion 41*b* is formed to have an outer diameter smaller than the outer diameter of the first sliding portion 411 and the second sliding portion 412. Furthermore, the expanded diameter flange portion 41*d* is formed at an end portion of the first sliding portion 411 so as to have an outer diameter larger than the outer diameter of the first sliding portion 411. A void portion 41*c* is formed around the constricted portion 41*b*.

The channel cross section adjustment spool 41 is subjected to an elastic bias force by the elastic member 45 so as to allow the constricted portion 41*b* to traverse the interior of the main channel 11 and to maximize the channel cross section of the main channel 11. In this case, oil in the main channel 11 flows through the void portion 41*c* between the constricted portion 41*b* and an inner wall of the main channel 11. An embodiment of the elastic member 45 is mainly a coil spring.

Oil flows into the channel cross section adjustment spool chamber 21 through the top inflow port 21*a* thereof, and thus, the expanded diameter flange portion 41*d* of the channel cross section adjustment spool 41 is pressed by oil flowing through the communication channel 3. The channel cross section adjustment spool 41 moves toward the sub-chamber portion 212 of the channel cross section adjustment spool chamber 21 against the elastic bias force of the elastic member 45.

Thus, the first sliding portion 411 in the main chamber portion 211 of the channel cross section adjustment spool chamber 21 projects into the main channel 11 to reduce the channel cross section of the main channel 11 which is now at maximum. This reduces the amount of oil supplied to downstream side of the channel open and close spool chamber 21. Furthermore, the first sliding portion 411 reduces the channel cross section of the main channel 11, and thus, the flow of oil is not completely blocked but simply the flow rate of the oil decreases.

The channel open and close valve 42 is disposed in the channel open and close valve chamber 22. The channel open and close valve 42 serves to block and allow the communication between the first communication channel 31 and second communication channel 32 forming the communication channel 3.

The channel open and close valve 42 is constantly pressed toward an axially top area of the channel open and close valve chamber 22 by the elastic bias force of the elastic member 46. As a result, the channel open and close valve 42 is positioned in the top area of the channel open and close valve chamber 22. This state is defined as an initial state of the channel open and close valve 42. In the initial state, the communication between the first communication channel 31 and second communication channel 32 forming the communication channel 3 is blocked (see FIG. 1B). Furthermore, the channel open and close valve 42 is shaped like a bottomed hollow cylinder and includes a communication through-hole 42*a* in a side surface portion thereof. The communication through-hole 42*a* performs a drain operation.

The channel open and close spool 43 is disposed in the channel open and close spool chamber 23. The channel open and close spool 43 serves to allow and block the communication between the downstream side branching channel 12 and the first communication channel 31 forming the communication channel 3.

The channel open and close spool 43 includes a first sliding portion 431, a second sliding portion 432, a third sliding portion 433, a first constricted portion 43*b*, and a second constricted portion 43*c*. The third sliding portion 433 is formed at any position between the first sliding portion 431 and the second sliding portion 432. The first sliding portion 431, the second sliding portion 432, and the third sliding portion 433 all have the same diameter.

Between the first sliding portion 431 and the third sliding portion 433, the first constricted portion 43*b* is present, which has a smaller diameter than the first sliding portion 431 and the third sliding portion 433. Between the third sliding portion 433 and the second sliding portion 432, the second constricted portion 43*c* is present, which has a smaller diameter than the third sliding portion 433 and the second sliding portion 432. The first constricted portion 43*b* is formed closer to the top portion of the channel open and close spool 43 than the second constricted portion 43*c*. A void portion 43*d* is formed around the first constricted portion 43*b* and the second constricted portion 43*c*.

The channel open and close spool 43 is constantly pressed toward an axially top area of the channel open and close spool chamber 23 by the elastic bias force of the elastic member 47. As a result, the channel open and close spool 43 is positioned in the top area of the channel open and close spool chamber 23. This state is defined as an initial state of the channel open and close spool 43. The elastic members 46 and 47 are mainly coil springs.

In a state where the channel open and close spool 43 is positioned in the top area of the channel open and close spool chamber 23, that is, in the initial state, the first constricted portion 43*b* is positioned between the side inflow port 23*b* and the side outflow port 23*c*. The side inflow port 23*b* and the side outflow port 23*c* are open via the void portion 43*d* around the first constricted portion 43*b*, thus allowing the downstream side branching channel 12 to communicate with the first communication channel 31. Furthermore, in the initial state, the second sliding portion 432 is positioned between the sub-inflow port 23*d* and the sub-drain port 23*e* to close the sub-inflow port 23*d* and the sub-drain port 23*e* (see FIG. 2).

Oil flows through the upstream side branching channel 13, which is in communication with the top inflow port 23*a* of the channel open and close spool chamber 23, to increase the hydraulic pressure in the channel open and close spool chamber 23 to move the channel open and close spool 43 against the elastic bias force of the elastic member 47. The first sliding portion 431 reaches the position of the side inflow port 23*b* and the side outflow port 23*c* to close the side inflow port 23*b* and the side outflow port 23*c*, thus blocking the communication between the downstream side branching channel 12 and the first communication channel 31. Thus, the flow of oil from the communication channel 3 to the channel cross section adjustment spool chamber 21 is stopped.

The channel cross section adjustment spool 41 is subjected to an elastic bias force by the elastic member 45 so as to allow the constricted portion 41*b* to traverse the interior of the main channel 11. Oil flows into the channel cross section adjustment spool chamber 21 through the second communication channel 32 to press the expanded diameter flange portion 41*d* of the channel cross section adjustment spool 41. The channel cross section adjustment spool 41 thus moves against the elastic bias force of the elastic member 45.

Now, the operation of the embodiment of the present invention will be described mainly in conjunction with a low rotation speed region, a medium rotation speed region, and a high rotation speed region of the engine. The low rotation speed region of the engine includes idling (also referred to as idling rotation). Between the low rotation speed region and the high rotation speed region of the engine, the vehicle travels, and thus, a load is imposed on the engine. However, in the idling region, the vehicle is stopped, and no traveling load is imposed on the engine.

Figure 2:
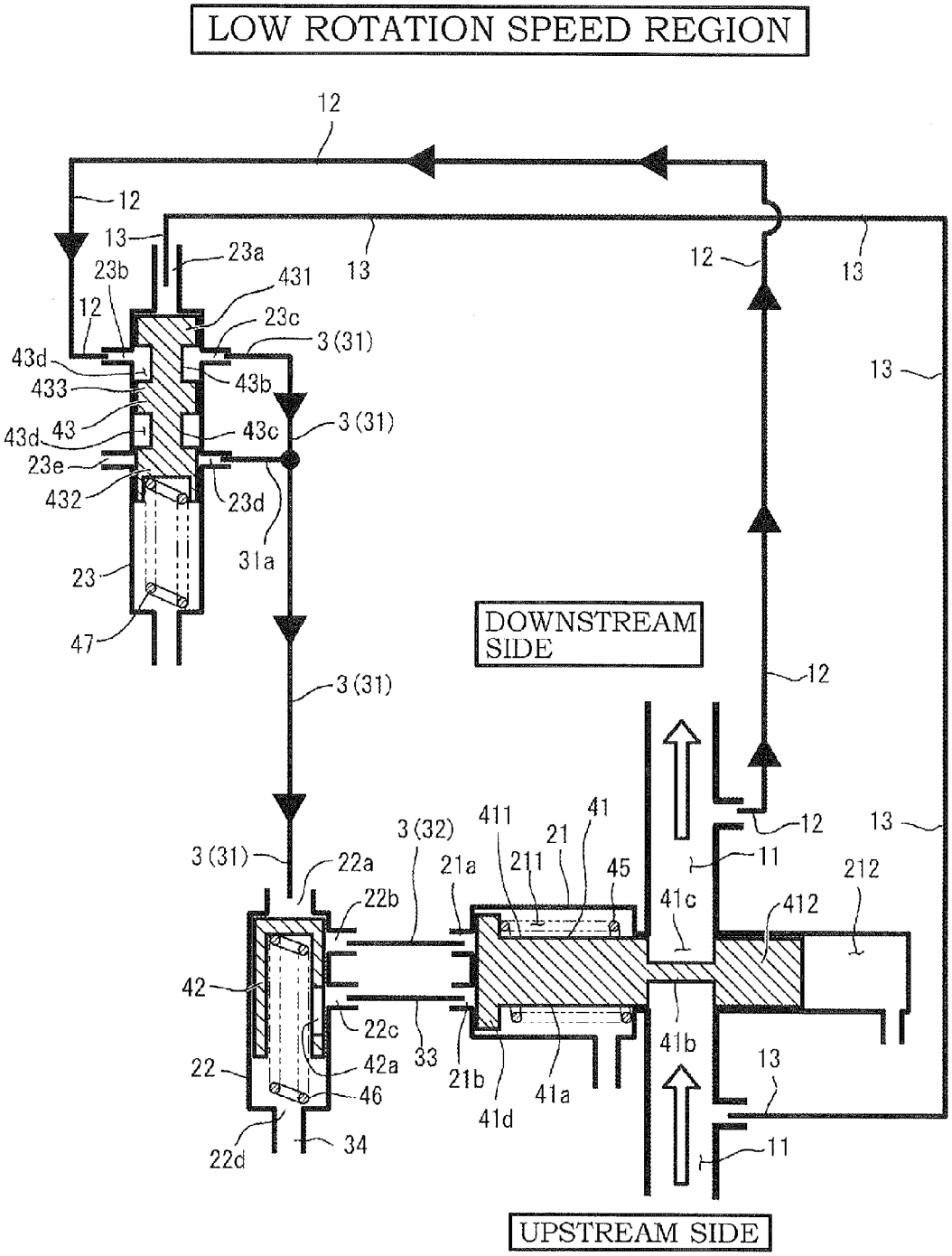
FIG. 2 is a diagram schematically showing operation of the control valve in a low rotation speed region of an engine.

In the low rotation speed region of the engine, the channel cross section adjustment spool 41 is set in the initial state by the elastic member 45 as shown in FIG. 2. That is, only the constricted portion 41*b* traverses the main channel 11 to maximize the channel cross section. Oil flows from the upstream side to the downstream side through the void portion 41*c* around the constricted portion 41*b* of the channel cross section adjustment spool 41.

At this time, oil flowing through the main channel 11 flows into the downstream side branching channel 12 and the upstream side branching channel 13. However, the channel open and close valve 42 and the channel open and close spool 43 are prevented from performing an opening or closing operation because the hydraulic pressure is sufficiently low compared to the elastic bias force of the elastic members 46 and 47. Thus, a hydraulic pressure on the downstream side of the channel cross section adjustment spool 41, that is, a crank shaft supply hydraulic pressure, is substantially equal to a hydraulic pressure on the upstream side of the channel cross section adjustment spool 41, that is, a valve gear supply hydraulic pressure.

Furthermore, in the low rotation speed region of the engine, control is avoided which reduces the hydraulic pressure. Thus, a sufficient hydraulic pressure and a sufficient flow rate can be ensured even in a region with a low rotation speed and an originally small pump discharge amount. The operation in the idling region is substantially equivalent to the operation in the low rotation speed region and is thus not illustrated.

Figure 3:
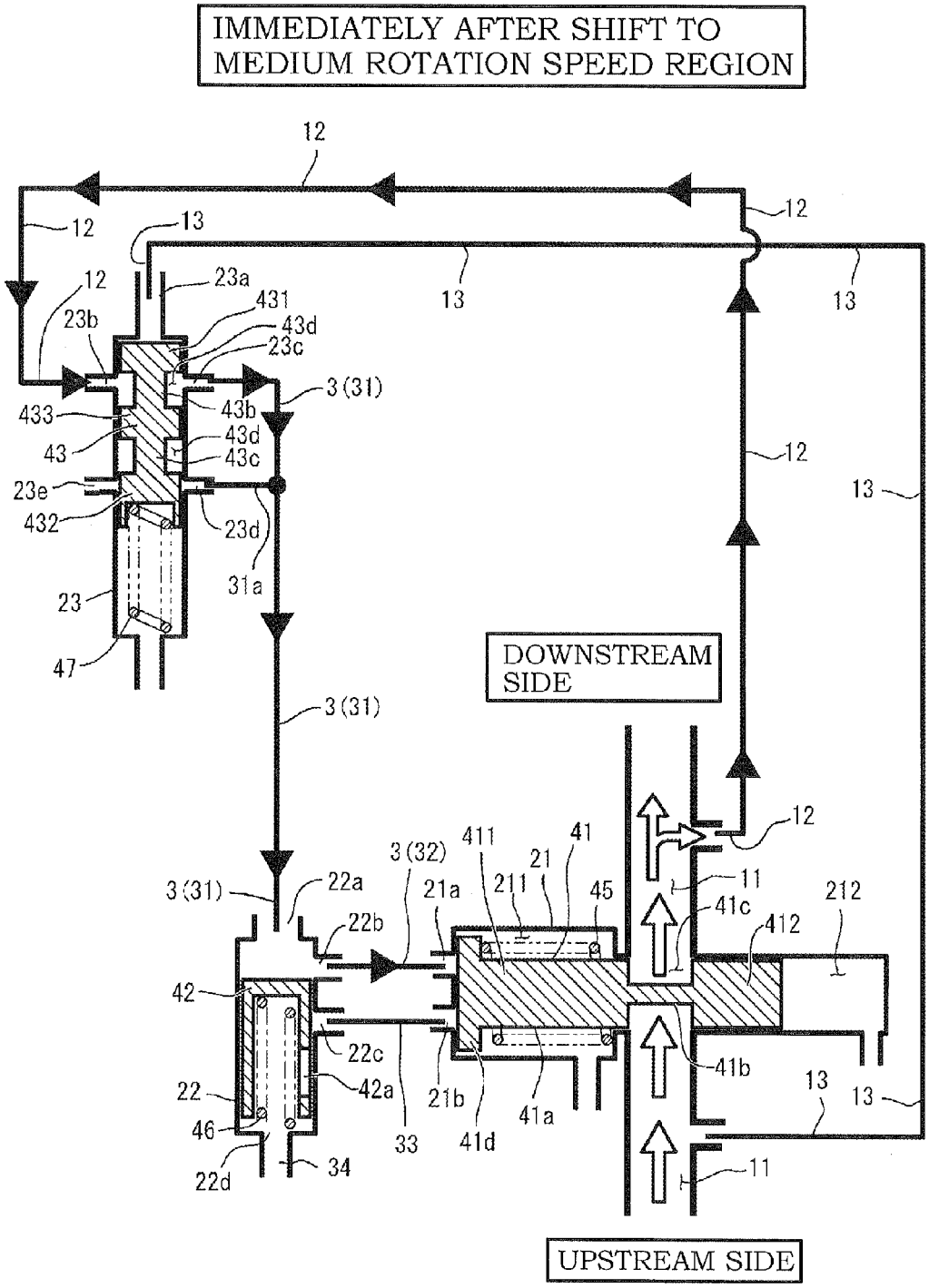
FIG. 3 is a diagram schematically showing operation of the control valve immediately after the engine shifts to a medium rotation speed.

Now, the state in the medium rotation speed region of the engine will be described. Immediately after a shift from the low rotation speed region to the medium rotation speed region, the pressure of oil flowing from the main channel 11 to the downstream side branching channel 12 increases (see FIG. 3). The oil flowing through the main channel 11 also flows through the upstream side branching channel 13. However, the force of the upstream side hydraulic pressure in the medium rotation speed region is lower than the elastic bias force of the elastic member 47, which elastically biases the channel open and close spool 43. Consequently, the channel open and close spool 43 is in a substantially immobile state and is thus kept in a substantially initial state.

Therefore, the first constricted portion 43*b* is positioned between the side inflow port 23*b* and the side outflow port 23*c* of the channel open and close spool chamber 23 to open the side inflow port 23*b* and the side outflow port 23*c*. Opening the side inflow port 23*b* and the side outflow port 23*c* allows the communication between the downstream side branching channel 12 and the first communication channel 31.

Furthermore, the increased pressure of the oil from the first communication channel 31 causes the channel open and close valve 42 to be pressed against the elastic bias force of the elastic member 46 and to move through the channel open and close valve chamber 22. Thus, the top inflow port 22*a* and the side outflow port 22*b* of the channel open and close valve chamber 22 are opened to allow the communication between the first communication channel 31 and the second communication channel 32 of the communication channel 3.

Figure 4:
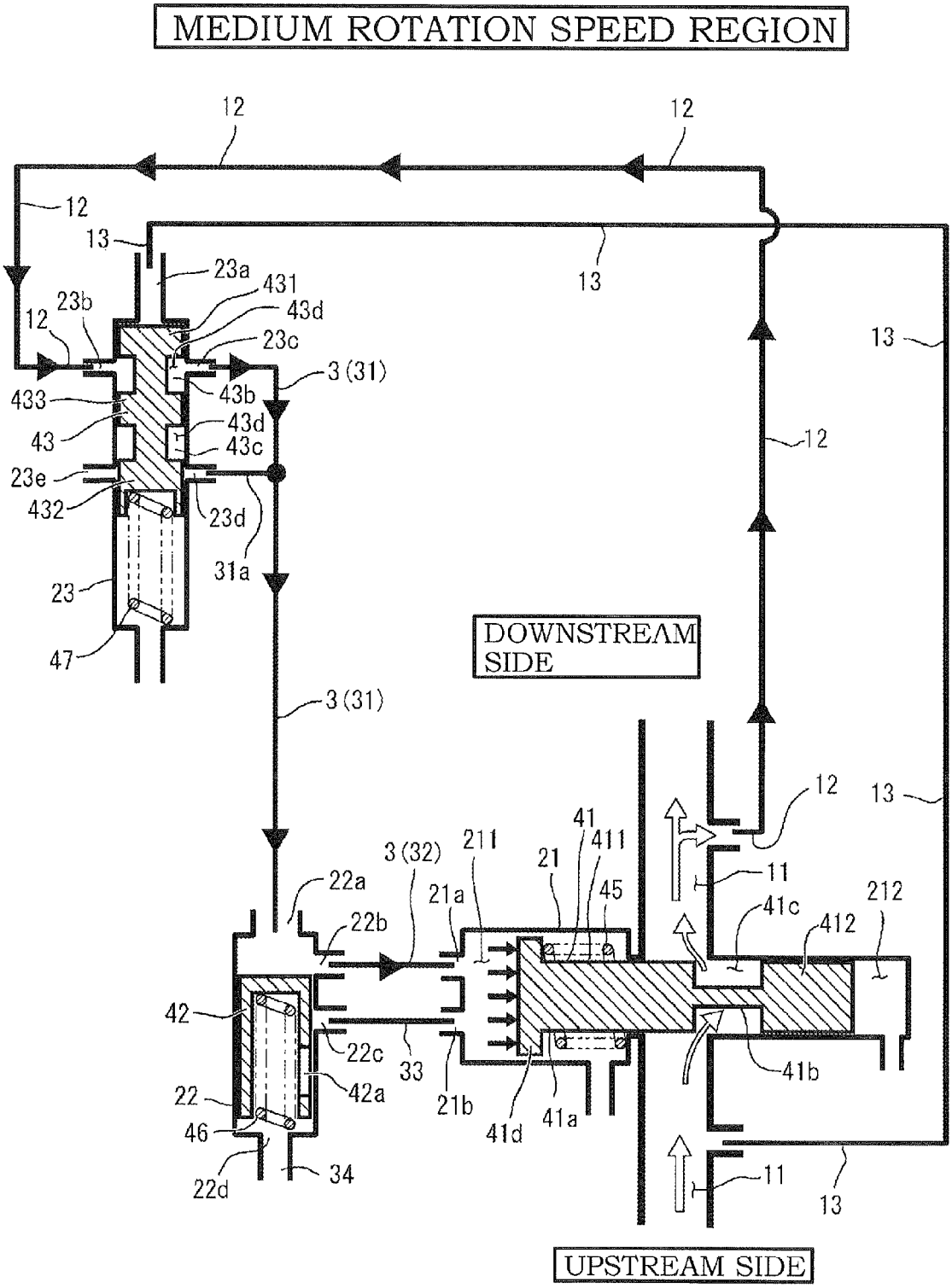
FIG. 4 is a diagram schematically showing operation of the control valve in a medium rotation speed region of the engine.

Moreover, the downstream side branching channel 12, the first communication channel 31, and the second communication channel 32 are allowed to communicate with one another. Oil flows through the downstream side branching channel 12 and the communication channel 3 (first communication channel 31 and second communication channel 32) into the channel cross section adjustment spool chamber 21 via the top inflow port 21*a*. At this time, the drain inflow port 22*c* and the drain discharge port 22*d* of the channel open and close valve chamber 22 are closed by the cylindrical side surface portion of the channel open and close valve 42 (see FIG. 4).

Thus, oil is prevented from flowing out from the channel cross section adjustment spool chamber 21 through the top outflow port 21*b*. The channel cross section adjustment spool chamber 21 moves against the elastic bias force of the elastic member 45. This movement changes the portion traversing the main channel 11 from the constricted portion 41*b* to the first sliding portion 411, reducing the channel cross section of the main channel 11.

That is, the channel cross section adjustment spool 41 moves to allow the first sliding portion 411 to reduce the channel cross section of the main channel 11, thus serving as an orifice. This reduces the flow rate of oil flowing through the main channel 11 from the upstream side to the downstream side.

However, the flow of oil is not completely stopped but simply decreases, and an amount of flow is maintained. Hence, the reduced channel cross section of the main channel 11 makes the hydraulic pressure on the downstream side of the control valve (equal to the crank shaft supply hydraulic pressure) lower than the hydraulic pressure on the upstream side of the control valve (equal to the valve gear supply hydraulic pressure).

Figure 5A:
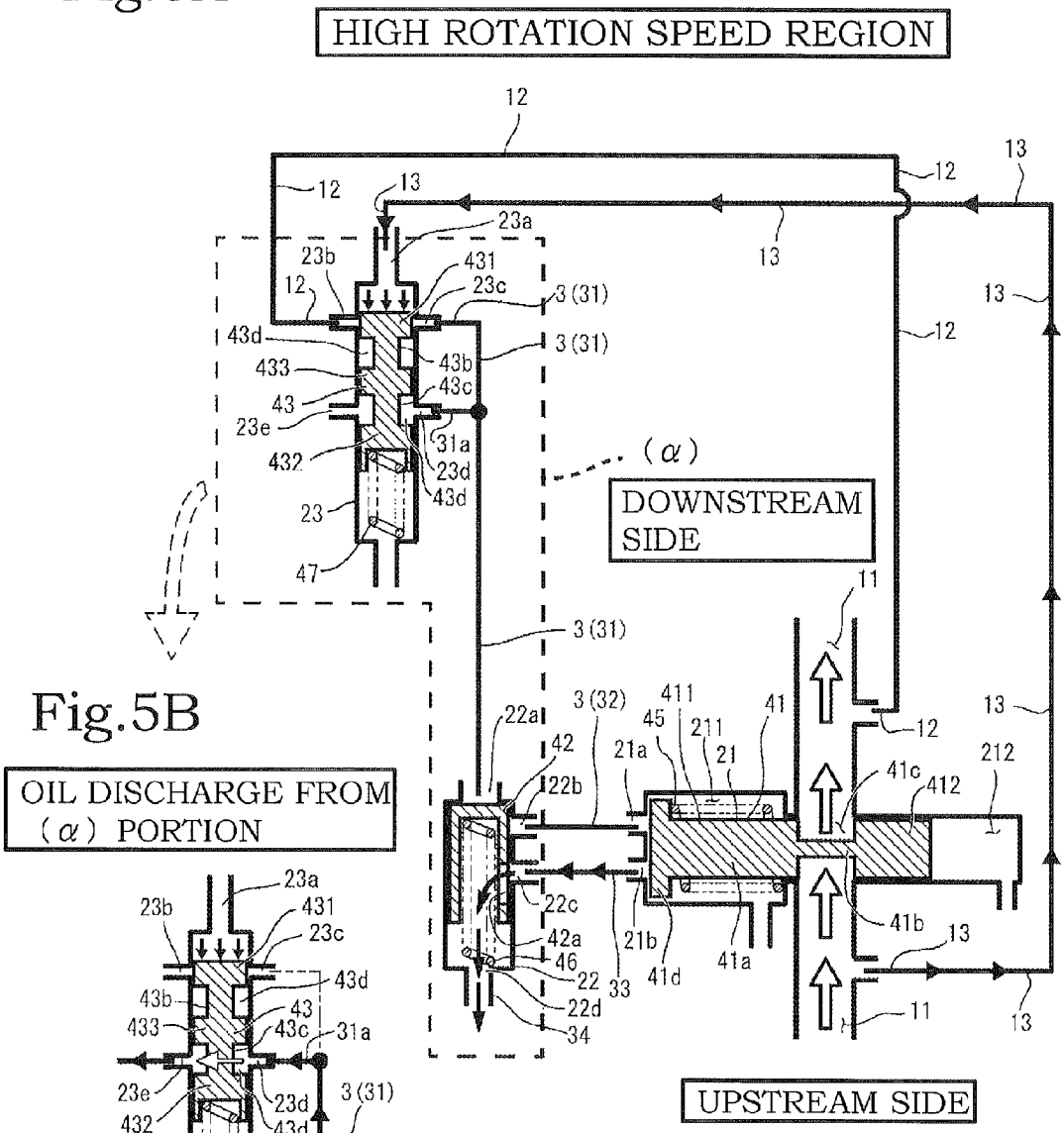
FIG. 5A is a diagram schematically showing operation of the control valve in a high rotation speed region of the engine.
Figure 5B:
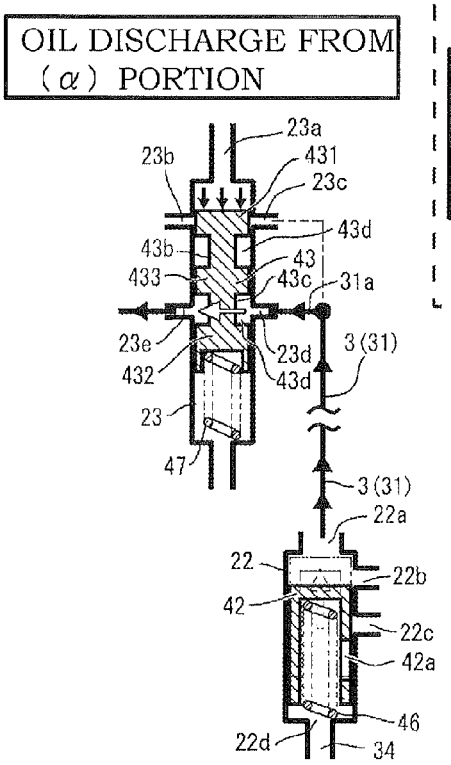
FIG. 5B is a diagram schematically showing a process in a portion ($\alpha$) in FIG. 5A in which oil in a channel open and close valve chamber is discharged to allow a return to an initial position.

In the high rotation speed region of the engine, the hydraulic pressure on the upstream side of the main channel 11 rises above the hydraulic pressure in the medium rotation speed region. This also raises the hydraulic pressure of oil fed from the main channel 11 to the channel open and close spool chamber 23 via the upstream side branching channel 13 (see FIG. 5). Thus, the channel open and close spool 43 moves toward the elastic member 47 against the elastic bias force of the elastic member 47.

Then, the first sliding portion 431 of the channel open and close spool 43 closes the side inflow port 23*b* and the side outflow port 23*c* of the channel open and close spool chamber 23. At the same time, the second sliding portion 432 closing the sub-inflow port 23*d* and the sub-drain port 23*e* moves, and the second constricted portion 43*c* reaches the position of the sub-inflow port 23*d* and the sub-drain port 23*e* to open the sub-inflow port 23*d* and the sub-drain port 23*e* for communication (see FIG. 5).

Then, in the high rotation speed region, the channel open and close valve 42 is freed from the pressure of oil from the first communication channel 31. The channel open and close valve 42 moves toward the top inflow port 22*a* by the elastic bias force of the elastic member 46 and returns to the initial position. During this process, the oil in the channel open and close valve chamber 22 and the first communication channel 31*e* is discharged through the sub-inflow port 23*d* and the sub-drain port 23*e* of the channel open and close spool chamber 23 via the sub-branching channel 31*a*, which braches from the middle of the first communication channel 31 (see FIG. 5B).

Furthermore, the channel open and close valve 42 is in the initial state, and the communication through-hole 42*a* in the channel open and close valve 42 is located at the same position as that of the drain inflow port 22*c* of the channel open and close valve chamber 22 in communication with the drain inflow port 22*c*. Thus, the channel cross section adjustment spool 41 is pressed by the elastic bias force of the elastic member 45.

Then, the oil collected in the channel cross section adjustment spool chamber 21 flows from the top outflow port 21*b* though the drain channel 33 and then through the drain inflow port 22*c* and the drain discharge port 22*d* of the channel open and close valve chamber 22 and the communication through-hole 42*a* in the channel open and close valve 42, and is discharged to the exterior of the housing A through the discharge channel 34. Thus, the channel cross section adjustment spool 41 can return smoothly to the initial position.

What is claimed is:

1. A control valve comprising:

a main channel;

a channel cross section adjustment spool installed in a middle of the main channel to increase and reduce a channel cross section;

a downstream side branching channel that branches from the main channel on a downstream side of a position of the channel cross section adjustment spool;

a communication channel through which oil is fed from the downstream side branching channel toward the channel cross section adjustment spool;

a channel open and close spool installed between the downstream side branching channel and the communication channel to allow and block communication between the downstream side branching channel and the communication channel;

a channel open and close valve installed in a middle of the communication channel; and an upstream side branching channel that branches from the main channel on an upstream side of the position of the channel cross section adjustment spool to supply a hydraulic pressure to the channel open and close spool, wherein, in a low rotation speed region of an engine, the channel open and close valve blocks the communication channel to maximize a channel cross section of the main channel, in a medium rotation speed region of the engine, the channel open and close spool allows the communication between the downstream side branching channel and the communication channel, and the channel open and close valve allows the communication channel to communicate to slide and move the channel cross section adjustment spool in a direction in which the channel cross section of the main channel is reduced, and in a high rotation speed region of the engine, the channel open and close spool blocks the communication between the downstream side branching channel and the communication channel to maximize the channel cross section of the main channel.

2. A control valve comprising:

a main channel;

a channel cross section adjustment spool installed in a middle of the main channel;

a downstream side branching channel that branches from the main channel on a downstream side of a position of the channel cross section adjustment spool;

a communication channel which is in communication with the downstream side branching channel and through which oil is fed to the channel cross section adjustment spool;

a channel open and close valve installed in a middle of the communication channel to allow and block communication of the communication channel; and an upstream side branching channel that branches from the main channel on an upstream side of the position of the channel cross section adjustment spool to supply a hydraulic pressure to the channel open and close spool, wherein the channel open and close spool blocks communication between the downstream side branching channel and the communication channel as a hydraulic pressure in the upstream side branching channel increases, the channel open and close valve allows the communication channel to communicate as a hydraulic pressure in the downstream side branching channel increases, and the channel cross section adjustment spool is elastically biased in such a manner as to maximize a channel cross section of the main channel, and moves in such a manner that the channel cross section is reduced as a hydraulic pressure from the communication channel increases.

3. The control valve according to claim 1, wherein a hydraulic pressure needed for the channel open and close valve to allow the communication channel to communicate is set lower than a hydraulic pressure needed for the channel open and close spool to block the communication between the downstream side branching channel and the communication channel.

4. The control valve according to claim 1, wherein a drain channel is provided between a channel cross section adjustment spool chamber in which the channel cross section adjustment spool is installed and a channel open and close valve chamber in which the channel open and close valve is installed, a discharge channel is formed in the channel open and close valve chamber, and the drain channel and the discharge channel are allowed to communicate with each other when the channel open and close valve blocks the communication channel.

5. The control valve according to 1, wherein a channel cross section adjustment spool chamber in which the channel cross section adjustment spool is installed is constituted by a main chamber portion and a sub-chamber portion which are orthogonal to the main channel, and the channel cross section adjustment spool reciprocates between the main chamber portion and the sub-chamber portion in such a manner as to traverse the main channel.

6. The control valve according to claim 2, wherein a hydraulic pressure needed for the channel open and close valve to allow the communication channel to communicate is set lower than a hydraulic pressure needed for the channel open and close spool to block the communication between the downstream side branching channel and the communication channel.

7. The control valve according to claim 2, wherein a drain channel is provided between a channel cross section adjustment spool chamber in which the channel cross section adjustment spool is installed and a channel open and close valve chamber in which the channel open and close valve is installed, a discharge channel is formed in the channel open and close valve chamber, and the drain channel and the discharge channel are allowed to communicate with each other when the channel open and close valve blocks the communication channel.

8. The control valve according to claim 3, wherein a drain channel is provided between a channel cross section adjustment spool chamber in which the channel cross section adjustment spool is installed and a channel open and close valve chamber in which the channel open and close valve is installed, a discharge channel is formed in the channel open and close valve chamber, and the drain channel and the discharge channel are allowed to communicate with each other when the channel open and close valve blocks the communication channel.

9. The control valve according to claim 2, wherein a channel cross section adjustment spool chamber in which the channel cross section adjustment spool is installed is constituted by a main chamber portion and a sub-chamber portion which are orthogonal to the main channel, and the channel cross section adjustment spool reciprocates between the main chamber portion and the sub-chamber portion in such a manner as to traverse the main channel.

10. The control valve according to claim 3, wherein a channel cross section adjustment spool chamber in which the channel cross section adjustment spool is installed is constituted by a main chamber portion and a sub-chamber portion which are orthogonal to the main channel, and the channel cross section adjustment spool reciprocates between the main chamber portion and the sub-chamber portion in such a manner as to traverse the main channel.

11. The control valve according to claim 4, wherein a channel cross section adjustment spool chamber in which the channel cross section adjustment spool is installed is constituted by a main chamber portion and a sub-chamber portion which are orthogonal to the main channel, and the channel cross section adjustment spool reciprocates between the main chamber portion and the sub-chamber portion in such a manner as to traverse the main channel.

* * * * *